US007160140B1

(12) United States Patent
Mrakovich et al.

(10) Patent No.: US 7,160,140 B1
(45) Date of Patent: Jan. 9, 2007

(54) LED STRING LIGHT ENGINE

(75) Inventors: Matthew Mrakovich, Streetsborough, OH (US); Ronald Brengartner, Jr., Strongsville, OH (US)

(73) Assignee: GELcore LLC, Valley View, OH (US)

( * ) Notice: Subject to any disclaimer, the term of this patent is extended or adjusted under 35 U.S.C. 154(b) by 0 days.

(21) Appl. No.: 11/180,993

(22) Filed: Jul. 13, 2005

(51) Int. Cl.
*H01R 4/24* (2006.01)
*H01R 4/26* (2006.01)
*H01R 11/20* (2006.01)

(52) U.S. Cl. ..... 439/417

(58) Field of Classification Search ..... 439/417–420
See application file for complete search history.

(56) References Cited

U.S. PATENT DOCUMENTS

| | | | | |
|---|---|---|---|---|
| 4,855,882 | A * | 8/1989 | Boss | 362/238 |
| 6,017,241 | A | 1/2000 | Komai | |
| 6,074,074 | A | 6/2000 | Marcus | |
| 6,505,955 | B1 | 1/2003 | Hatjasalo et al. | |
| 6,517,218 | B1 * | 2/2003 | Hochstein | 362/294 |
| 6,566,824 | B1 * | 5/2003 | Panagotacos et al. | 315/291 |
| 6,834,980 | B1 | 12/2004 | Okano et al. | |
| 6,837,598 | B1 | 1/2005 | Marcus | |
| 2002/0149948 | A1 | 10/2002 | Okano et al. | |
| 2005/0221659 | A1 * | 10/2005 | Mrakovich et al. | 439/404 |
| 2006/0035511 | A1 * | 2/2006 | Mrakovich et al. | 439/404 |
| 2006/0116021 | A1 * | 6/2006 | Dennes et al. | 439/445 |

FOREIGN PATENT DOCUMENTS

| | | |
|---|---|---|
| EP | 0 818 652 B1 | 7/1997 |
| EP | 1 233 232 A2 | 11/2001 |
| WO | WO 90/02906 | 3/1990 |
| WO | WO 2004/023033 | 3/2004 |

OTHER PUBLICATIONS

Philips catalog, Solid State Lighting Beyond Neon: Philips LED String System.

* cited by examiner

*Primary Examiner*—James R. Harvey
(74) *Attorney, Agent, or Firm*—Fay, Sharpe, Fagan, Minnich & McKee, LLP

(57) ABSTRACT

A string light engine includes a plurality of LEDs, a plurality of IDC connectors, and an insulated flexible conductor. Each IDC connector is in electrical communication with at least one of the plurality of LEDs and is operatively mechanically connected to at least one of the plurality of LEDs. The IDC connectors attach to the conductor.

19 Claims, 4 Drawing Sheets

LED STRING LIGHT ENGINE

BACKGROUND OF THE INVENTION

LED string light engines are used for many applications, for example as accent lighting, architectural lighting, and the like. The profile, i.e. the height and width, of known flexible LED light string engines is wide enough such that it can be difficult to install these known light string engines in certain environments.

LED string light engines are also used in channel letters. A typically channel letter has a five inch can depth, which is the distance between the rear wall of the channel letter and the translucent cover. To illuminate the channel letter, a string LED light engine attaches to the rear wall and directs light towards the translucent cover. To optimize efficiency, typically the LEDs are spaced from one another as far as possible before any dark spots are noticeable on the translucent cover. To achieve no dark spots, the LEDs are spaced close enough to one another so that the light beam pattern generated by each LED overlaps an adjacent LED as the light beam pattern contacts the translucent cover. Accordingly, the translucent cover is illuminated in a generally even manner having no bright spots nor any dark spots.

Channel letters are also manufactured having a shallower can depth, such as about two inches. Typically, the smaller channel letters also have a smaller channel width. If the same light string engine that was used to illuminate the smaller channel letters is used to illuminate the larger channel letters, then bright spots may be noticeable because the beam pattern overlap is not as great where the beam pattern contacts the translucent cover.

SUMMARY

In one embodiment, a light string engine includes a conductor, a first support, a second support, a first IDC connector, a second IDC connector, a first LED, a second LED, a first overmolded housing, and a second overmolded housing. In this embodiment, the conductor is a flexible insulated electrical conductor. The first support and the second support each include a dielectric layer and circuitry. The second support is spaced from the first support along a length of the conductor. The first IDC connector and the second IDC connector each extend away from the first support and the second support, respectively. Each IDC connector is in electrical communication with the circuitry of the respective support. Each IDC connector includes a terminal that is inserted into the conductor to provide an electrical connection between the conductor and the respective circuitry. The first LED mounts to the first support and is in electrical communication with the circuitry of the first support. The second LED mounts to the second support and is in electrical communication with the circuitry of the second support. The first overmolded housing at least substantially surrounds the first support and a portion of the conductor adjacent the first support. The second overmolded housing at least substantially surrounds the second support and a portion of the conductor adjacent the second support.

An example of a method of manufacturing a string light engine includes the following steps: connecting a first LED assembly to an insulated conductor; connecting a second LED assembly to the insulated conductor; overmolding a first housing over at least a portion of the first LED assembly and a portion of the insulated conductor; and overmolding a second housing over at least a portion of the second LED assembly and a portion of the insulated conductor. Each LED assembly includes a support an LED mounted to the respective support and an IDC connector operatively fastened to the respective support.

An embodiment of a thin, low-profile string light engine includes a plurality of LEDs, a plurality of IDC connectors, and an insulated flexible conductor. Each IDC connector is in electrical communication with at least one of the plurality of LEDs and is operatively mechanically connected to at least one of the plurality of LEDs. The conductor includes at least two wires. The IDC connectors are inserted into the conductor. The conductor includes a first portion where the IDC connector is inserted into the conductor where the at least two wires reside generally in a first plane. The conductor also includes a second portion spaced along the length of the conductor from the first portion. The at least two wires reside in a second plane in the second portion. The second plane is at an angle other than 180° as compared to the first plane.

DETAILED DESCRIPTION

Figure 1:
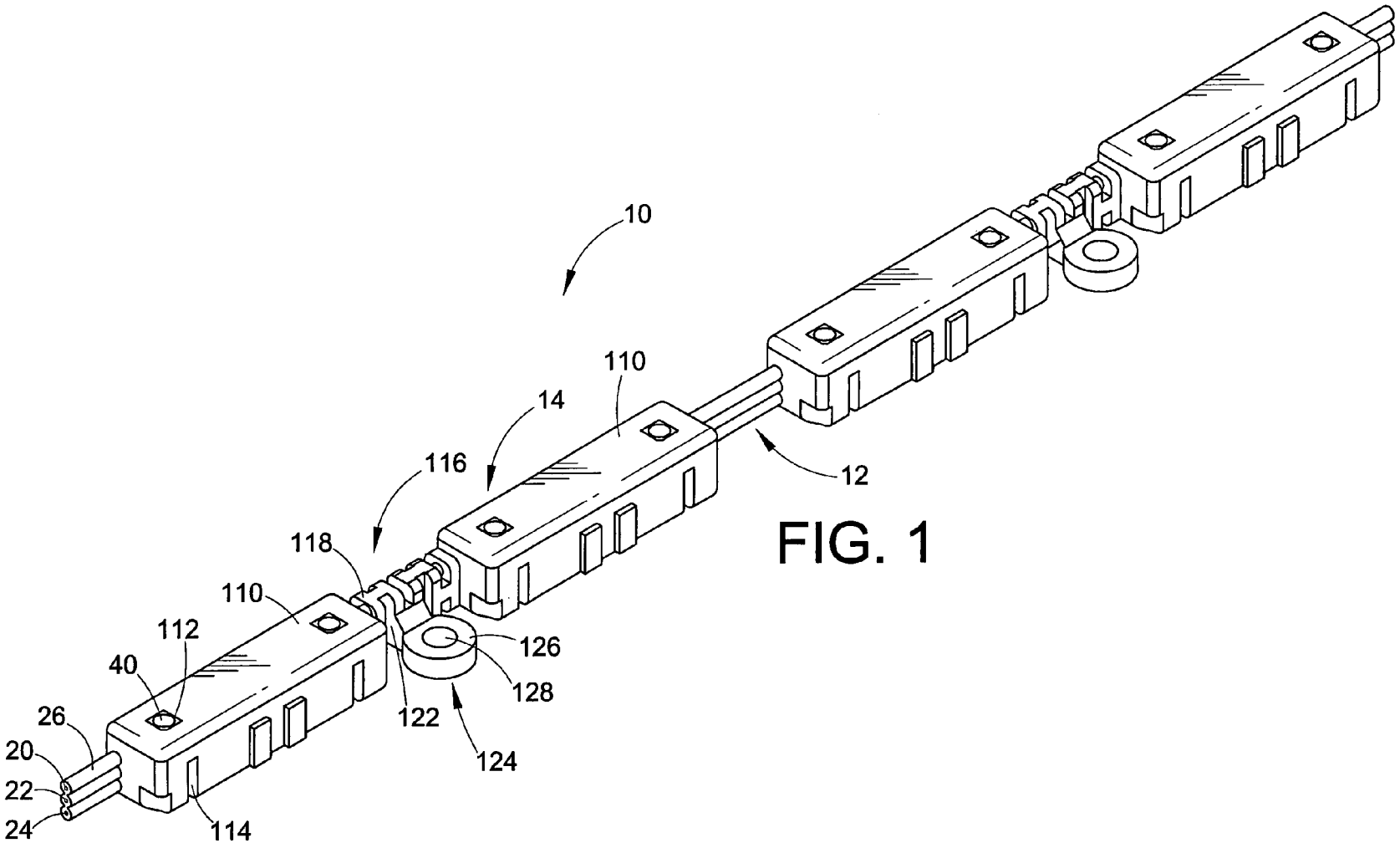
FIG. 1 is a perspective view of a string light engine.

With reference to FIG. 1, a flexible LED string light engine 10 generally includes a flexible electrical power conductor 12 and LED modules 14 attached along the length of the conductor. The light engine 10 is flexible so that it can be bent and shaped into many desirable configurations so that it can fit into, for example a channel letter, and can be used in many different environments. FIG. 1 depicts only a portion of the light engine which can extend along a much greater distance than that depicted in FIG. 1. The string light engine 10 can be manufactured to have the length of many feet or meters long. In one embodiment, the light sources, which will be described in more detail below, are spaced relatively close to one another to provide a desired beam overlap pattern. The string light engine 10 is configured to easily bend in a manner that will be described in more detail below.

The power conductor 12 in the depicted embodiment includes three conductor wires: a positive (+) conductor wire 20, a negative (−) conductor wire 22 and a series conductor wire 24. Accordingly, the LED modules 14 can be arranged in a series/parallel arrangement along the power conductor 12. A fewer or greater number of conductor wires can be provided. The wires in the depicted embodiment are 22 gage, however other size wires can also be used. The conductor wires 20, 22 and 24 are surrounded by an insulating material 26.

In the depicted embodiment, the power conductor 12 is continuous between adjacent LED modules 14 such that the entire power conductor 12 is not cut or otherwise terminated to facilitate a mechanical or electrical connection between the LED module and the power conductor. A continuous power conductor 12 quickens the manufacturing of the light engine 10, as compared to light engines that terminate the power conductor when connecting it to an LED module.

Figure 2:
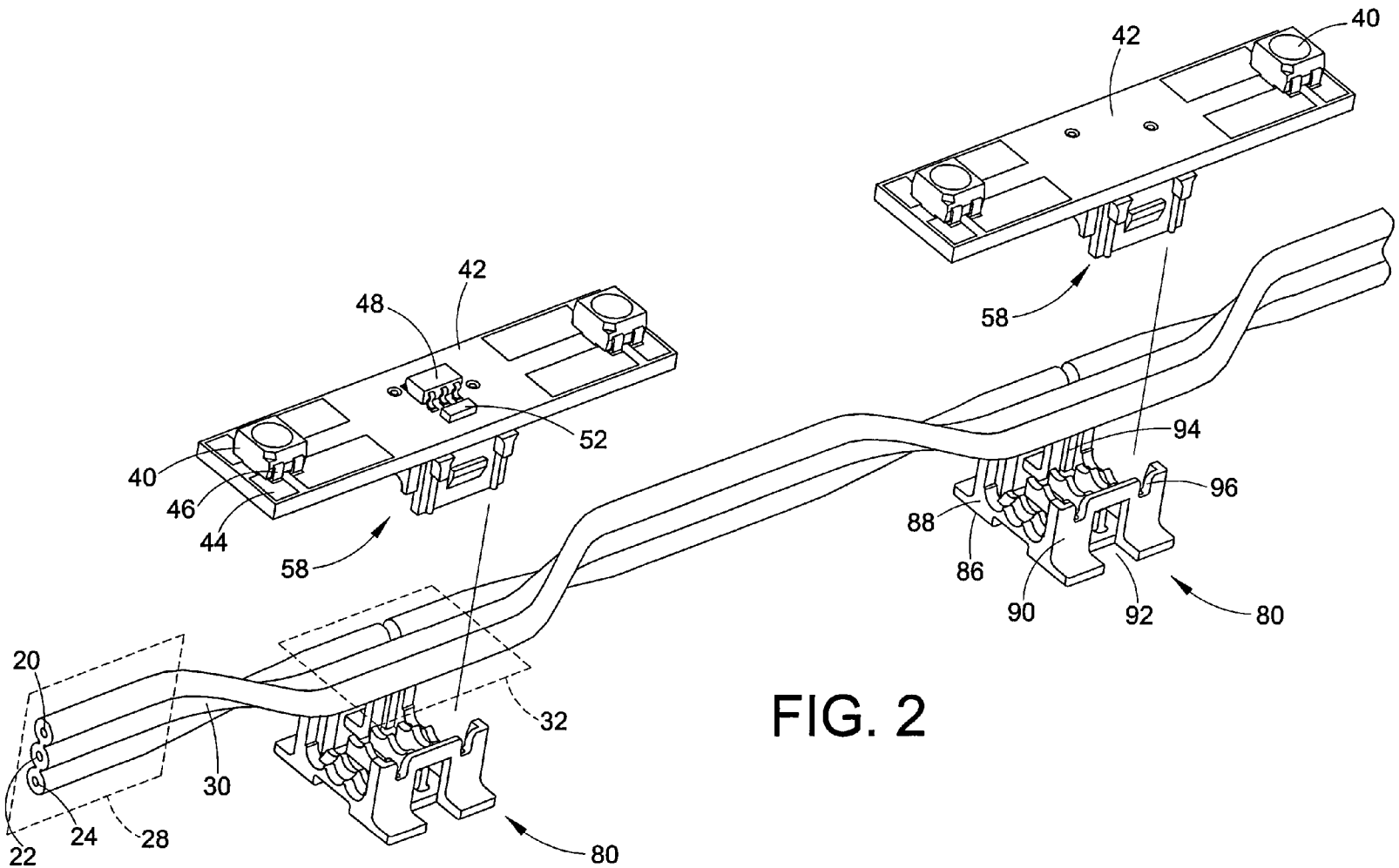
FIG. 2 is an exploded perspective view of components of the string light engine of FIG. 1.

The wires 20, 22 and 24 of the power conductor can be described as residing generally in a plane at different locations along the length of the power conductor. With reference to FIG. 2, the power conductors reside in a first or primary bending plane 28 adjacent each LED module. As seen in FIG. 2, the power conductor 12 includes a twist 30, which in the depicted embodiment is a one-quarter twist, such that the power conductor resides in a second or connection plane 32 where the LED module attaches to the power conductor 12. In an alternative embodiment, the twist 30 may not be a one-quarter twist; rather, the twist may be smaller where the two planes 28 and 32 may only be at an angle other than 180° from one another. The configuration of the power conductor 12 allows the LED light string 10 to easily bend in a direction that is at an angle to the primary bending plane 28. This is because the force(s) required to bend the power conductor 12 in the primary bending plane 28 is small because the width of the power conductor in the primary bending plane 28 is equal to the diameter of a conductor wire and the surrounding insulation as compared to the width of the power conductor in the connection plane 32 which equals the entire width of the power conductor 12. The twist 28 allows for a low-profile LED module to attach to the power conductor 12. In other words, the height and width of each LED module 14 can be smaller, as compared to known light string engines.

Figure 3:
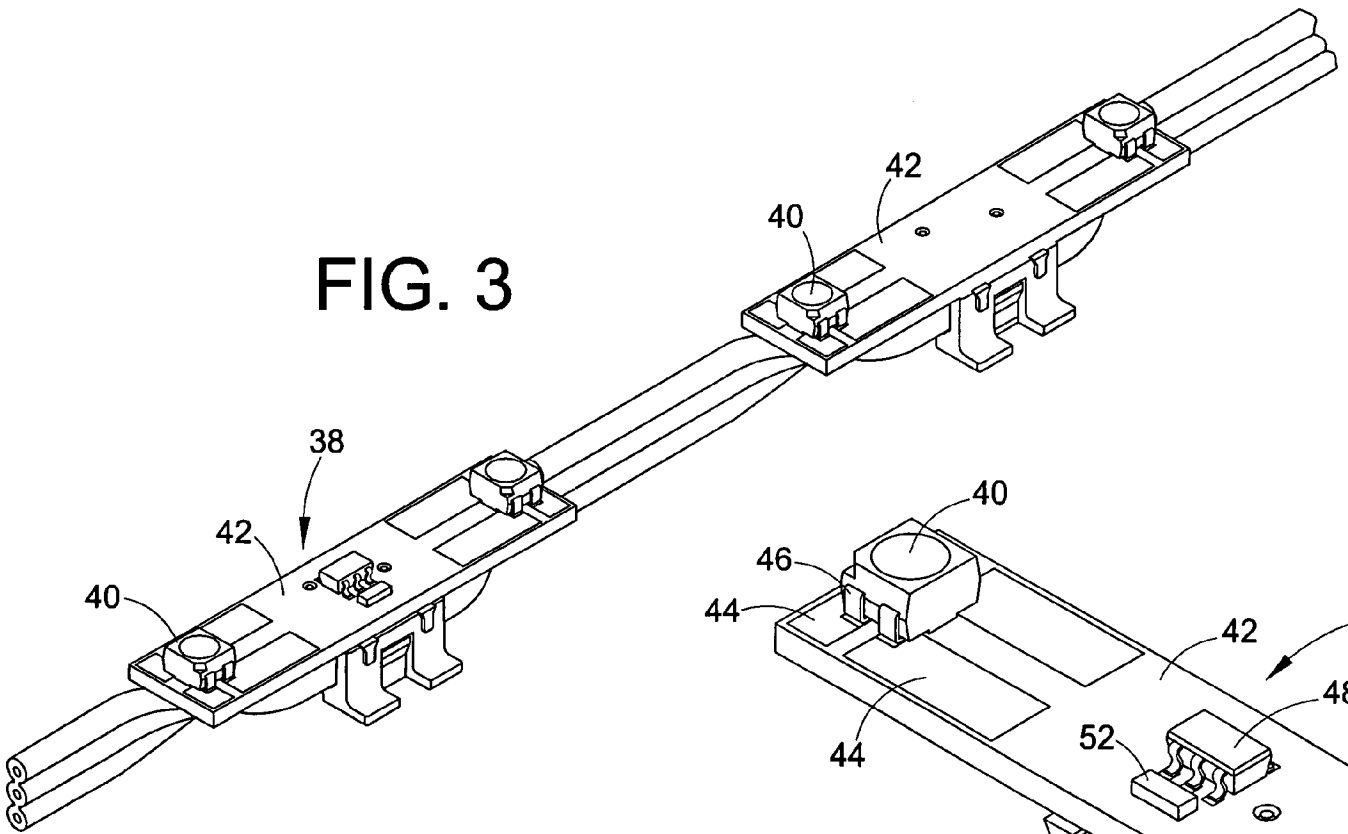
FIG. 3 is an assembled view of the string light engine of FIG. 1 prior to overmolding a housing on the string light engine.
Figure 4:
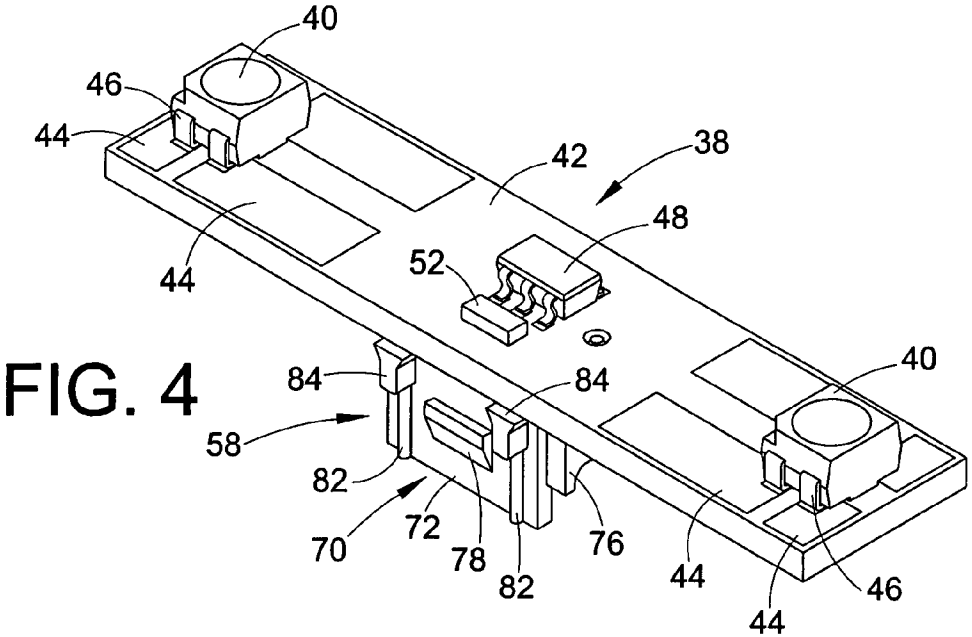
FIG. 4 is a perspective view of an assembly of the string light engine of FIG. 1.

The LED modules 14 attach to the power conductor 12 spaced along the length of the power conductor. In the embodiment depicted and as seen in FIG. 3, each LED module 14 includes an assembly 38 that attaches to the power conductor 12. With reference to FIG. 4, the assembly 38 includes at least one LED 40 (two LEDs are shown), which in the depicted embodiment is a surface mounted LED, placed on a support 42, which in the depicted embodiment is a printed circuit board ("PCB"). In the depicted embodiment, the printed circuit boards 42 that mount to the power conductor 12 have similar dimensions (see FIG. 3); however, the circuitry located on each PCB and the components that mount to each PCB can be different. Solder pads 44 are disposed on an upper dielectric surface of each PCB 42. Leads 46 for each LED 40 electrically connect to the solder pads 44.

An LED driver 48 mounts on the upper surface of some of the printed circuit boards 42. The LED driver 48 is in electrical communication with the LEDs 40. A resistor 52 also mounts on the upper surface of some of the printed circuit boards 42. the resistor 52 is also in communication with the LEDs 40. In the depicted embodiment some PCBs 42 are provided without resistors and LED drivers and some PCBs are not (see FIGS. 2 and 3). Accordingly, the circuitry located on each PCB 42 interconnecting the LEDs 40 to the power conductor 12 is different. In the depicted embodiment, two different wiring configurations are provided for the PCBs: one wiring configuration for the PCB having the resistor and LED driver and one wiring configuration for the PCB having no resistor or LED driver.

In an alternative embodiment, the support upon which the LED is mounted can be a flex circuit or other similar support. Furthermore, the LEDs that mount to the support, either the flex circuit or the PCB, can include chip on board LEDs and through-hole LEDs. Also, other electronics can mount to the support including a device that can regulate the voltage as a function of the LED temperature or the ambient temperature. Furthermore, these electronics, including the resistor, the LED driver, and any temperature compensating electronics can be located on a component that is in electrical communication with the LEDs but not located on the support.

With reference back to the depicted embodiment as seen in FIG. 4, an IDC connector 58 depends from a lower surface of the support 42. In the depicted embodiment, the IDC connector 58 is mechanically fastened to the support 42, which operatively connects the IDC connector to the LEDs 40. Even though the IDC connector is depicted as directly attaching to the support 42, other elements or components can be interposed between the two. When the IDC connector 58 attaches to the power conductor 12, the support 42 resides in a plane generally parallel with the connection plane 32 (FIG. 2).

Figure 5:
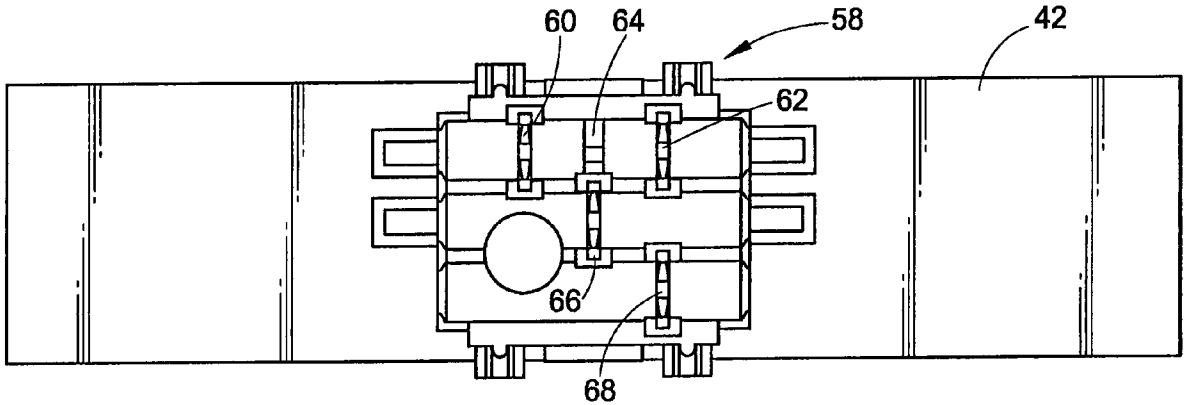
FIG. 5 is a bottom view of the assembly of FIG. 4.

With reference to FIG. 5, in the depicted embodiment the IDC connector 58 includes a plurality of IDC terminals. A first series IDC terminal 60 depends from a lower surface of the support 42 and is in electrical communication with the LEDs 40 through circuitry (not shown) printed on the upper dielectric layer of the support 42. A second IDC terminal 62 is spaced from the first series IDC terminal 60 and also depends from the lower surface of the support 42. The second series IDC terminal 62 is also in communication with the LEDs 40. The first and second series IDC terminals 60 and 62 pierce the insulation 26 surrounding the series wire 24 to provide an electrical connection between the LEDs 40 and the series wire. The IDC connector 58 in this embodiment also includes an insulative barrier 64 disposed between the first series terminal 60 and the second series terminal 62.

A negative IDC terminal 66 also depends from a lower surface of the support 42. Similar to the first series IDC terminal 60 and the second series IDC terminal 62, the negative IDC terminal 66 is in electrical communication with the LEDs 40 via circuitry disposed on an upper dielectric surface of the support 42. The negative IDC terminal 66 displaces insulation surrounding the negative wire 22 to provide an electrical connection between the LEDs 40 and the negative wire. A positive IDC terminal 68 also depends from a lower surface of the support 42. The positive IDC terminal 68 is in electrical communication with the LEDs 40 via circuitry provided on an upper surface of the support 42. The positive IDC terminal 68 displaces insulation 26 surrounding the positive wire 20 to provide for an electrical connection between the LEDs 40 and the positive wire. In the depicted embodiment, each IDC connector 58 has the same electrical configuration. The support 42 to which the connector 58 attaches has a different electrical configuration based on the electrical components mounted on the support. For example, the IDC terminals for one connector can electrically communicate with the resistor 52 and/or the LED driver 48 that is located on some of the supports 42.

Figure 6:
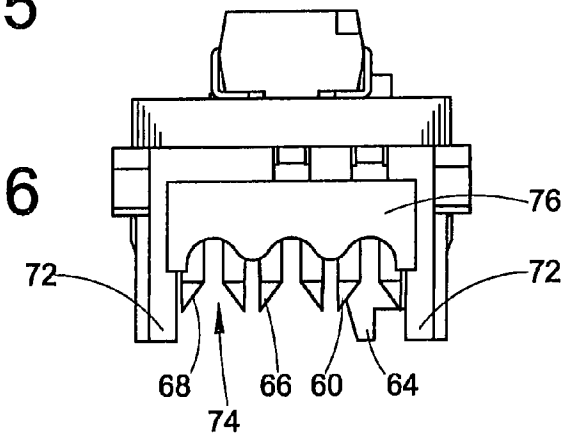
FIG. 6 is an end view of the assembly of FIG. 4.

With reference back to FIG. 4, the IDC connector 58 also includes an IDC connector housing 70 that includes dielectric side walls 72, which in the depicted embodiment are made of plastic, that depend from opposite sides of the support 42 in the same general direction as the IDC terminals. As seen in FIGS. 5 and 6, the IDC terminals 60, 62, 66 and 68 are disposed between the sidewalls 72. With reference to FIG. 6, the sidewalls 72 are spaced from one another to define a channel 74 configured to snugly receive the power conductor 12. A power conductor seat 76 depends from a lower surface of the support 42 in the same general direction as the IDC connectors and the sidewalls 72. The seat 76 includes three curved recesses, one recess for each wire of the power conductor 12. A tab 78 extends from each sidewall 72 to facilitate attaching the IDC connector housing 70 to an IDC cover 80 (FIG. 2). Each sidewall 72 also includes vertical ridges 82 formed on opposite sides of each tab 78. The vertical ridges 82 also facilitate attachment of the IDC connector housing 70 to the IDC cover 80. Stops 84 extend outwardly from each sidewall 72 at an upper end of each vertical ridge 82. The stops 84 extend further from each sidewall 72 than the vertical ridges 82.

As seen in FIG. 2, the IDC cover 80 includes a base wall 86 defining an upwardly extending power conductor seat 88 that includes curved portions for receiving the separate wires of the power conductor 12. The curved portions of the power conductor seat 88 align with the curved portions of the power conductor seat 74 of the IDC connector housing 70. Sidewalls 90 extend upwardly from opposite sides of the base wall 86 of the IDC cover 80. Each sidewall 90 includes an opening 92 configured to receive the tab 78 extending outwardly from each sidewall 72 of the IDC connector housing 70. Internal vertical notches 94 are formed on an inner surface of each sidewall 90 to receive the vertical ridges 82 formed on the sidewalls 72 of the IDC connector housing 70. Notches 96 are formed in each sidewall 90 of the IDC cover 80 to receive the stops 84 formed on the IDC connector housing 70.

The support 42 attaches to the power conductor 12 by pressing the support into the power conductor 12 such that the IDC terminals 60, 62, 66 and 68 displace the insulation 26 around each wire of the power conductor. The cover 80 is then pressed toward the support 42 such that the tabs 78 lock into the notches 92 to secure each support 42 to the power conductor 12. The tabs 78 are ramped to facilitate this connection. When attached to the power conductor 12, the support resides in a plane that is generally parallel to the connection plane 32.

With reference back to FIG. 1, an overmolded housing 110 at least substantially surrounds each support 42 and a portion of the conductor 12 adjacent each support. The overmolded housing includes openings 112 through which an upper surface of each LED 40, which is typically covered by a lens, extends. Accordingly, in the depicted embodiment the overmolded housing 110 does not completely encapsulate the support 42 to an LEDs 40; however, if desired the housing could cover the LEDs 40, especially if the housing were to be made of a light-transmissive material. Each overmold housing 110 also includes notches 114 formed in the overmold housing for supporting the support 42 during overmolding, which will be described in more detail below.

In the depicted embodiment, a strain relief member 116 is disposed between adjacent overmolded housings 110 and surrounds the power conductor 12. The strain relief member 116 includes a plurality of loops 118 that surround the power conductor 12 and are separated by openings 122. The strain relief members are configured to limit any forces on the conductor 12 that are external the overmolded housing 110 from transferring to the portion of the power conductor 12 disposed inside the overmolded housing. This is to limit any stresses on the IDC connector 58 so that good mechanical and electrical connection is maintained between the support 42 and the IDC connector.

A mounting element 124 connects to the power conductor 12 extending from the strain relief member 116. In the depicted embodiment, the mounting element 124 comprises a loop 126 defining an opening 128 dimensioned to receive a fastener (not shown). The mounting element 124 can take alternative configurations to allow the light engine 10 to attach to a mounting surface. Furthermore, the light engine 10 can mount to a mounting surface via an adhesive that attaches to either the power conductor 12 or the overmold housing 110, as well as in other conventional manners.

Figure 7:
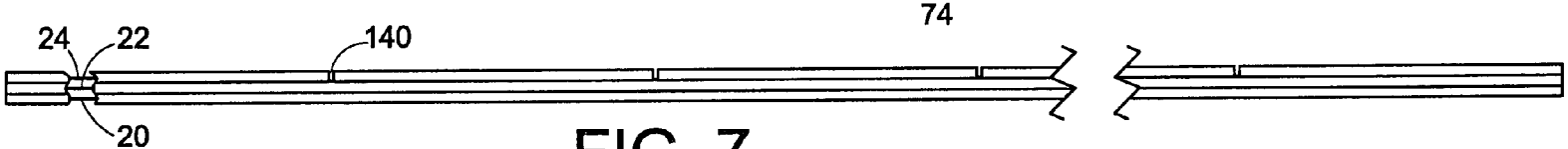
FIG. 7 is a plan view of a power conductor of the string light engine of FIG. 1.

To assemble the light engine 10 the series conductor wire 24 of the power conductor 12 is punched out to form slots 140 (FIG. 7) at predetermined locations along the power conductor 12. The power conductor 12 is twisted (see FIG. 2). Each support 42 and the accompanying IDC connector housing 70 and IDC terminals 60, 62, 66 and 68 are disposed such that the connector insulation barrier member 64 (FIGS. 5 and 6) of each IDC connector housing is disposed inside the slot 140 and the IDC terminals contact the respective conductor wires of the power conductor 12. The IDC cover 80 is then fit over the IDC connector housing 70 so that the power conductor 12 is fully seated in each of the power conductor seats 74 and 86. The overmolded housing 110 is then formed over the support 42 and the power conductor 12 adjacent the support.

With reference back to FIG. 1, in one method two adjacent housings 110 and the interconnecting strain relief member 116 along with the mounting element 124 are formed from as an integral unit. Two adjacent supports 42 can be inserted into a mold and a thermoplastic, for example a thermoplastic elastomer, is injected into the mold to form the overmolded housing 110. Instead of an elastomer, i.e. a material that is flexible after solidifying, the overmolded housing can also be a rigid plastic, or other suitable material. When using the injection molding thermoplastic process as described above, the thermoplastic is typically injected at pressures between about 5–35 kpsi and at temperatures in the range of about 140–500° C., and typically between about 140–230° C. The thermoplastic then cools and is removed from the mold. Alternatively, the overmolded housing can be formed using a liquid injection molding process and/or a casting process. The power conductor 12 and the assembly 38 can also be run through an extruder so that the overmolded housing is extruded over the assembly and the power conductor.

In other embodiments the entire light engine 10, or a substantial portion thereof, can be overmolded. The thermoplastic used to make the overmolded housing can be opaque. As discussed above, the upper surface of each LED 42 is not covered; however, in an alternative embodiment the upper surface of each LED can be covered where the overmolded housing is formed of a light-transmissive material. The overmolded housing 110 provides a further mechanical connection between the support 42 and the power conductor 12 as well as acting as a barrier from the elements for the components disposed inside the overmolded housing. The overmolded housing 110 also provides for thermal management of the LED modules 14. The overmolded housing 110 increases the surface area of the LED module, as compared to having no housing, which has been found to lower the thermal resistance to the ambient, as compared to having no housing.

A string light engine and a method for manufacturing the string light engine has been described with reference to certain embodiments. Modifications and alterations will occur to those upon reading and understanding the detailed description. The invention is not limited to only those embodiments described above; rather, the invention is defined by the appended claims and the equivalents thereof.

The invention claimed is:

1. A string light engine comprising:

a flexible insulated electrical conductor;

a first support comprising a dielectric layer and circuitry;

a first IDC connector extending away from the first support and in electrical communication with the circuitry of the first support, the first IDC connector comprising a terminal that is inserted into the conductor to provide an electrical connection between the conductor and the circuitry of the first support;

a first LED mounted on the first support and in electrical communication with the circuitry of the first support; and a first overmolded housing at least substantially surrounding the first support and a portion of the conductor adjacent the first support.

2. The light engine of claim 1, further comprising:

a second support comprising a dielectric layer and circuitry, the second support being spaced from the first support along a length of the conductor;

a second IDC connector extending away from the second support and in electrical communication with the circuitry of the second support, the second IDC connector comprising a terminal that is inserted into the conductor to provide an electrical connection between the conductor and the circuitry of the second support;

a second LED mounted on the second support and in electrical communication with the circuitry of the second support; and a second overmolded housing at least substantially surrounding the second support and a portion of the conductor adjacent the second support.

3. The light engine of claim 2, wherein at least one of the first support and the second support comprises a printed circuit board.

4. The light engine of claim 2, wherein the circuitry of the first support is electrically different than the circuitry of the second support, and the first IDC connector and the second IDC connector have the same electrical configuration.

5. The light engine of claim 2, wherein at least one of the first housing and the second housing includes a strain relief member configured to limit any forces on the conductor that are external the housing to transfer to the portion of the conductor disposed within the housing.

6. The light engine of claim 2, further comprising a mounting element connected to at least one of the conductor, the first housing and the second housing.

7. The light engine of claim 2, wherein the first overmolded housing and the second overmolded housing are formed as an integral unit.

8. The light engine of claim 1, wherein the conductor includes a twist such that a first portion of the conductor that is spaced from the first support along the length of the conductor resides in a first plane and a second portion of the conductor where the terminal of the first IDC connector is inserted resides in a second plane that is generally perpendicular to the first plane.

9. The light engine of claim 8, wherein the first support resides in a plane that is generally parallel to the second plane.

10. The light engine of claim 1, wherein the first IDC connector is mechanically connected to the first support.

11. The light engine of claim 1, wherein the conductor includes a first conductor wire, a second conductor wire and a third conductor wire.

12. The light engine of claim 11, wherein the first IDC connector includes a first terminal that contacts the first conductor wire, a second terminal that contacts the second conductor wire, a third terminal that contacts the third conductor wire and a fourth terminal that contacts the third conductor wire.

13. The light engine of claim 12, further comprising an insulative barrier disposed between the third terminal and the fourth terminal.

14. The light engine of claim 1, wherein the first overmolded housing comprises a thermoplastic elastomer material.

15. A thin, low-profile string light engine comprising:

a plurality of LEDs;

a plurality of IDC connectors, each IDC connector being in electrical communication with at least one of the plurality of LEDs and operatively mechanically connected to at least one of the plurality of LEDs;

an insulated flexible conductor including at least two wires, the IDC connectors including a terminal inserted into the conductor, the conductor including a first portion where the IDC connector is inserted into the conductor where the at least two wires reside generally in a first plane and a second portion spaced along a length of the conductor from the first portion, in the second portion the at least two wires reside in a second plane that is at an angle other than 180° as compared to the first plane.

16. The light engine of claim 15, wherein the conductor includes a twist disposed between the first portion and the second portion.

17. The light engine of claim 15, further comprising a plurality of supports, each support being connected to at least one of the IDC connectors and at least one of the LEDs.

18. The light engine of claim 15, further comprising an overmolded housing at least partially encapsulating at least one of the plurality of LEDs, at least one of the plurality of IDC connectors and at least a portion of the flexible conductor.

19. The light engine of claim 18, wherein the overmolded housing comprises material having heat conductive properties that are greater than air.

* * * * *